US005144341A

United States Patent [19]

El Haten et al.

[11] Patent Number: 5,144,341

[45] Date of Patent: Sep. 1, 1992

[54] THERMAL INK JET DRIVERS DEVICE DESIGN/LAYOUT

[75] Inventors: Abdul M. El Haten, Hawthorne; Steven A. Buhler, Redondo Beach; Putul D. Patel, Diamond Bar, all of Calif.

[73] Assignee: Xerox Corporation, Stamford, Conn.

[21] Appl. No.: 692,087

[22] Filed: Apr. 26, 1991

[51] Int. Cl.[5] ..... B41J 2/05

[52] U.S. Cl. ..... 346/140 R

[58] Field of Search ..... 346/140 R

[56] References Cited

U.S. PATENT DOCUMENTS 4,532,530 7/1985 Hawkins ..... 346/140 R
4,601,777 7/1986 Hawkins et al. ..... 156/626
4,720,716 1/1988 Ikeda et al. ..... 346/140 R
4,887,098 12/1989 Hawkins et al. ..... 346/140 R
5,053,790 10/1991 Stephenson ..... 346/76 PH

*Primary Examiner*—Joseph W. Hartary
*Attorney, Agent, or Firm*—Daniel J. O'Neill

[57] ABSTRACT

A thermal ink jet printer utilizes a printhead whose electrical connections to the heating elements used to expel the ink droplets has been modified to reduce the effects of parasitic resistance of a first power bus when a number of resistors are simultaneously addressed. The first power bus has been modified by forming and interconnecting to it a second power bus using a low resistance connection which is formed to crossover, or under, a common return. The second power bus is connected at each end to a predetermined voltage, while the first power bus is connected at each end through a series ballast resistor to the same predetermined voltage.

18 Claims, 3 Drawing Sheets

THERMAL INK JET DRIVERS DEVICE DESIGN/LAYOUT

BACKGROUND OF THE INVENTION

This invention relates to thermal ink jet printing systems and, more particularly, to an improved printhead design incorporating multiple levels of interconnection and ballast resistors for the resistive thermal energy generators.

Side shooter thermal ink jet printers are well known in the prior art as exemplified by U.S. Pat. No. 4,601,777. In the systems disclosed in this patent, a thermal printhead comprises one or more ink-filled channels communicating with a relatively small ink supply chamber at one end and having an opening at the opposite end, referred to as a nozzle. A plurality of heating resistors are located in the channels at a predetermined distance from the nozzle. The heating resistors are individually addressed with a current pulse to momentarily vaporize the ink and form a bubble which expels an ink droplet. As the bubble grows, the ink bulges from the nozzle and is contained by the surface tension of the ink as a meniscus. As the bubble begins to collapse, the ink still in the channel between the nozzle and bubble starts to move towards the collapsing bubble, causing a volumetric contraction of the ink at the nozzle and resulting in the separating of the bulging ink as a droplet. The acceleration of the ink out of the nozzle while the bubble is growing provides the momentum and velocity of the droplet in a substantially straight line direction towards a recording medium, such as paper.

In typical applications, ink droplets can be ejected at a rate of 5 kHz, giving rise to process speeds of up to 15 inches per second at 300 spots per inch (spi) printing resolution. To achieve practical print speeds, it is necessary to print with arrays of about 20 or more nozzles which are constructed preferably at the same pitch as pixels to be printed. Printers with small nozzle count use a scanning printhead and typically have print speeds of 1 page per minute (ppm). In order to print at speeds above 10 ppm, it is necessary to build a page width print bar which typically contains several thousand jets. With process speeds of 15 inches per second, it is possible to print over 100 ppm with such architectures at 300 spi resolution. Therefore, to enable high throughput thermal ink jet print engines, page width print bars are essential.

The performance of the printhead depends strongly on the distance between the heating resistor and the nozzle. Drop size, drop velocity, and frequency of ink droplet ejection all depend on the distance between the heating resistor and the nozzle. Three hundred spot per inch printing performance is optimized when the heating resistor begins about 120 ppm behind the nozzle. The proximity of the heating resistors to the nozzle, coupled with the high packing density necessary for high density printing have the implication that electrical front lead connection to one end of the heating resistors must be made across the front of the heating resistor array. The short distance from the nozzle to the heating resistor requires the front lead to be narrower than 120 ppm. For arrays of jets designed to operate up to a couple of pages per minute, the configuration where one end of the heating resistors is connected in common from both ends of the array is satisfactory. The problems with wider arrays, such as page width, emerge because of the heating resistor energy requirement for printing, coupled with higher common lead resistance.

As mentioned previously, the thermal ink jet process uses rapid boiling of ink for drop ejection. Electrical heating pulses are applied for a few microseconds and must dissipate sufficient energy in the heating resistor to raise its surface temperature to about 300° C. in order for bubble nucleation to occur. Typical energies required for drop ejection are between 10 and 50 microjoules ($\mu$j), depending on the transducer structure and design. It is necessary to apply the energy within a short time, such as 3 to 5 microseconds. Therefore, about 8 watts are being dissipated during the heating pulse. The current necessary for heating depends on the resistance value of the transducer. If a resistance value of 200 ohms is chosen, then 200 mA of current is required and the device operates at 40 V. It is desirable to use high operating voltages so that currents are lowered, but high voltage adversely effects heating resistor lifetime. Therefore, a moderate voltage such as 40 or 60 V is chosen.

Another requirement of the circuit used for thermal ink jet printing is imposed by the drop ejection frequency ($\approx$5 kHz or a period of 200 $\mu$sec) and the heating pulse length of $\approx$5 $\mu$sec. In the 200 $\mu$sec period, only 40 jets can be fired. However, monolithic printheads can be made using the present semiconductor process technology with about 300 ink channels. Therefore, for maximum efficiency, the printhead must be capable of firing 4 to 12 jets simultaneously. (Of course, the exact number fired during any particular time depends on the document data being printed.)

Another important consideration is the uniformity of the drops ejected from the various channels of a printhead. In order for the threshold for drop ejection to be the same when one jet or all jets are fired, the lead which connects the heating resistors to the power supply should have negligible resistance in comparison with the resistive elements. Tests have shown that a difference of only 1% in the power delivered to a heating resistor produces on the printed page a visible difference in drop size. Another factor contributing to nonuniform drop size occurs in the case in which MOS drive transistors, fabricated on the printhead, are used to supply current pulses to the heating resistors. The parasitic resistance of the front common can lead to variations in the $V_{gs}$ of the drive transistors.

For the case just discussed, 4 simultaneously fired jets have a total resistance of 50 Ω. An array of two hundred jets with a resolution of 300 spots per inch is 0.666 inches, or 17,000 $\mu$m, long. The width of the metallization in front of the heating resistors is $\approx$100 $\mu$m, so there is 170 □ of metal. For typical commercial metal thickness (1.25 $\mu$m) and deposition techniques, aluminum has a sheet resistance of 0.032 Ω/□. Therefore, the common metal lead has an end to end resistance of 5.5 Ω. By connecting the metal on both ends, the resistance seen by the middle 4 heating resistors is 1.35 Ω, or 2.7% of the heating resistor resistance.

From the above example, it can be seen that as the number of jets within a module grows, more jets must be simultaneously fired and the parasitic resistance effect caused by the aluminum common connection increases. The practical upper limit before an alternative approach needs to be considered is a consequence of the overvoltage which will be applied when only one heating resistor is fired, given that all elements need to fire if selected. Overvoltage increases power dissipation, shortens element lifetime, and causes drop nonuniformity. For the devices considered here, 4 to 6 simultaneously fired jets is the maximum which is practical.

In addition to the problem of the parasitic resistance effect, a second problem when using the aluminum common connection for wide arrays is the connection of the common between a plurality of chips which have been butted together to form the wide array. In order to butt together arrays of modules, each module must terminate so the spacing between it and its neighbors does not give rise to a noticeable and undesirable stitch error. It is well known that printing irregularities as small as 25 μm can be seen. Therefore, the modules must be within a few micrometers of their correct location. As an example, at 300 spi, 84.5 μm is the pixel spacing. The thermal ink jet channel structure takes up about 65 μm, leaving ≈20 μm for creation of a butted joint. The 20 μm joint can not deviate more than ±5 μm before perceptible image quality degradation occurs. There is insufficient space at the ends of the module to make a low resistance connection to the common power lead which runs along the front edge of the module. Even when single modules containing many heating resistors are fabricated and front common leads can be brought out at the ends of the array, it may be desirable to make additional interconnections to the common in order to avoid parasitic voltage drop when many elements are simultaneously fired.

One approach to overcoming the above-mentioned limitations is disclosed by U.S. Pat. No. 4,887,098, which shows the common connection modified by forming two commons and interconnecting them with leads that pass between adjacent heating resistors. By providing a second common, the first common located between the heating resistor and nozzle can be made relatively narrow enabling the heating resistor to be located at an optimum distance upstream of the nozzle without being restricted by the width of the unmodified wider common. The heating resistor are connected to the heating pulse source by a low resistance structure which crosses over, or under, the second common. In one embodiment the low resistance crossover structure is a heavily-doped polysilicon layer and the second common is aluminum. Other possible combinations shown include an n+ diffusion in a p-type wafer and aluminum; refractory metal silicides and aluminum, either a single or double level metal process. These embodiments have the effect of decreasing the parasitic resistance associated with the single common and providing additional space to make the interconnection between butted-together chips.

The approach disclosed in U.S. Pat. No. 4,887,098 generally performs well in reducing the affects of parasitic resistance of the first common. In particular, the use of a second common reduces the resistance seen by the middle four heating resistors in an array. However, since the space between adjacent heating resistors is relatively narrow, the leads that interconnect the first and second commons are themselves relatively narrow, and are prone to parasitic resistance. The parasitic resistance of the interconnecting leads can result in the resistance seen by the middle four heating resistors being significantly greater than the resistance seen by an end four heating resistors.

SUMMARY OF THE INVENTION

According to one embodiment of the present invention, the printhead disclosed in U.S. Pat. No. 4,887,098 is modified by providing the front common with ballast resistors at both ends of the array. By providing the front common with ballast resistors, the resistance seen by an end four heating resistors is increased to be more nearly that seen by the middle four heating resistors. Overall, ballast resistors having the appropriate resistance value make the resistance seen by any heating resistor in the array is more nearly the same. In this manner, variations in drop size are reduced.

More particularly, the invention is directed towards an ink jet printhead of the type having a plurality of channels, each channel being supplied with ink and having an opening which serves as an ink droplet ejecting nozzle a heating element being positioned in each channel, ink droplets being ejected from the nozzles by the selective application of current pulses to the heating elements in response to data signals from a data signal source, the heating elements transferring thermal energy to the ink causing the formation and collapse of temporary vapor bubbles that expel the ink droplets, said printhead further comprising a common return and a first and second electrically conductive power bus, said first power bus provided with ballast resistors at both ends, said power busses interconnected by leads extending between said heating resistors by a low resistance connection which is formed beneath or above said common return.

Other features of the present invention will become apparent as the following description proceeds and upon reference to the drawings, in which.

DESCRIPTION OF THE PREFERRED EMBODIMENT

While the present invention will hereinafter be described in connection with a preferred embodiment and method of manufacture, it will be understood that it is not intended to limit the invention to that embodiment. On the contrary, it is intended to cover all alternatives, modifications, and equivalents as may be included within the spirit and scope of the invention as defined by the appended claims.

Figure 1:
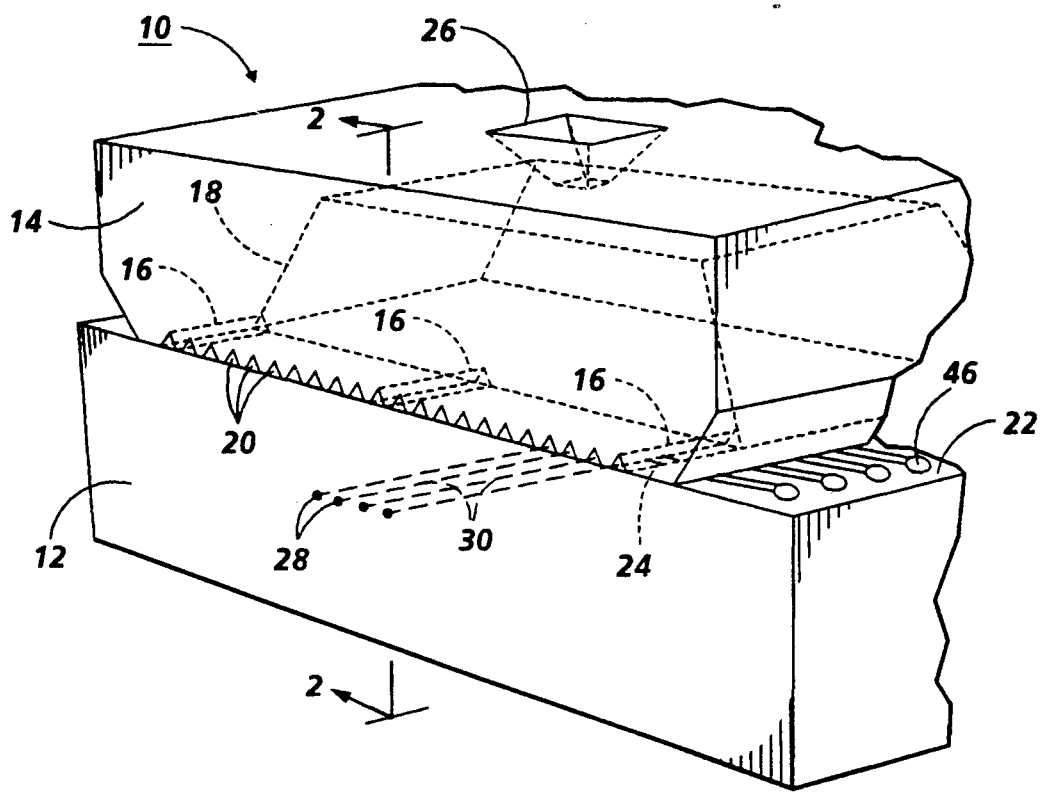
FIG. 1 PRIOR ART
FIG. 1 is an enlarged isometric view of a prior art side shooter ink jet printhead to which the invention relates.
Figure 2:
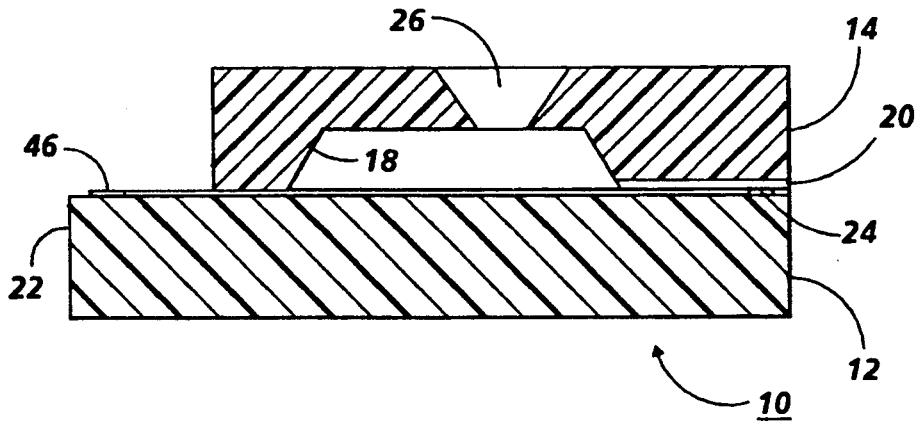
FIG. 2 PRIOR ART
FIG. 2 is an enlarged cross-sectional view of the printhead of FIG. 1.
Figure 3:
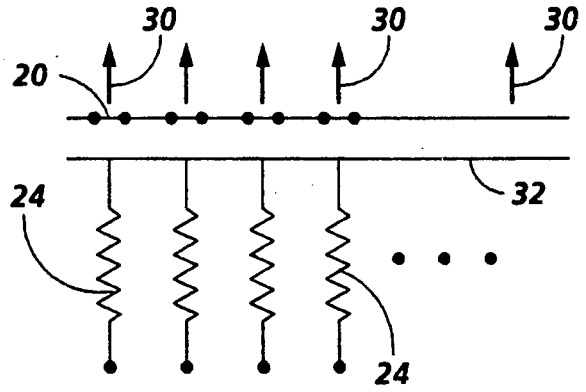
FIG. 3 PRIOR ART
FIG. 3 is a partial schematic top view of the prior art heater board included in the printhead of FIG. 1.
Figure 4:
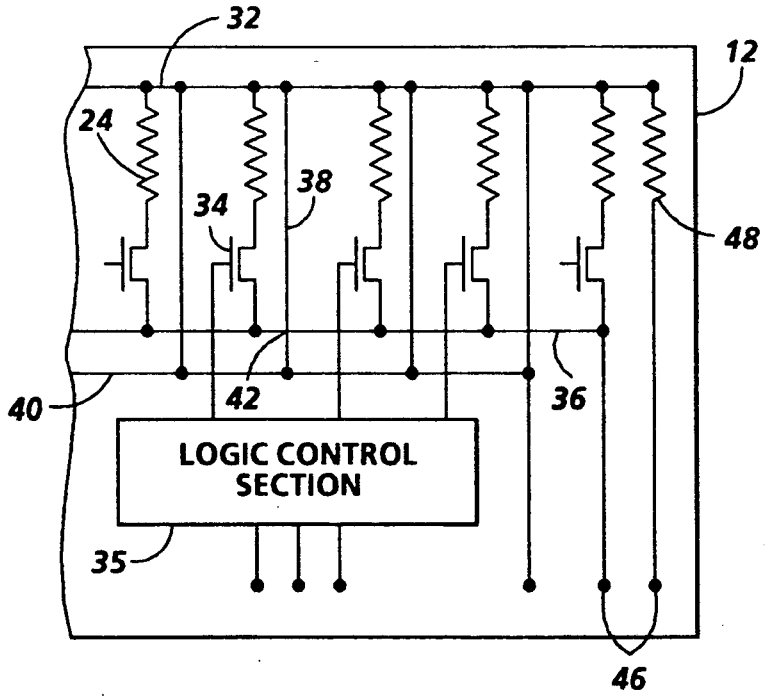
FIG. 4 is a partial schematic top view of the improved heater included in the printhead board of FIG. 1.

Referring now to FIGS. 1, 2, 3 and 4, there is shown a preferred embodiment of a side shooter thermal ink jet (TIJ) printhead 10 embodying the present invention. Printhead 10 comprises an electrically insulated substrate heater board 12 permanently attached to a structure board 14. Structure board 14 includes parallel triangular cross-sectional grooves 16 which extend from an ink reservoir 18 in one direction and penetrate through front edge of printhead 10. Heater board 12 is aligned and bonded to the surface of structure board 14 with grooves 16 so that ink channels 20 are formed by grooves 16 and the surface 22 of the heater board 12, and so that a respective one of the plurality of ink channels 20 has positioned in it a respective one of the plurality of heating resistors 24. Ink reservoir 18 can be filled with ink through fill hole 26. Referring now to FIGS. 1, 3, and 4, ink drops 28 are ejected from channels 20 along paths 30 in response to current pulses sent to heating resistors 24 by drive transistors 34 controlled by logic control section 35. In FIG. 1, while only 24 ink channels 20 are shown for illustrative purposes, it is understood that many more channels may be formed within a single printhead 10. A preferred technique for forming drive transistors 34 by monolithic integration of MOS transistor switches onto the same silicon substrate containing heating resistors 24 is described in U.S. Pat. No. 4,947,192.

Referring now to FIGS. 3 and 4, there are shown top schematic views of heater board 12 which depict the electrical connection to heating resistors 24. As shown, each heating resistor 24 is connected to a front power bus 32. Front power bus 32 is an aluminum lead deposited at the edge of heating resistors 24 in the relatively narrow space between heating resistors 24 and the front edge of printhead 10. Each heating resistor 24 is also connected at its end opposite front power bus 32 to a respective drive transistor 34. Drive transistors 34 are connected to common return 36, which is an aluminum lead. To reduce the parasitic resistance of front power bus 32, side busses 38 connect front power bus 32 to rear power bus 40. Rear power bus 40 is an aluminum lead positioned on the side of common return 36 opposite drive transistors 34. Side busses 38 extend from front power bus 32 to rear power bus 40 in the relatively narrow spaces between adjacent heating resistors 24 and their respective adjacent drive transistors 34.

Side busses 38 are aluminum leads, except for portion 42 of each side bus 38 that passes under common return 36. Each side bus portion 42 consists of low resistance diffusion resistors that are insulated from common return 36. Alternatively, side bus portion 42 could be made of other low resistance material, such as heavily doped polysilicon or metal silicide, and could pass over rather than under common return 36. Preferred techniques for forming side busses 38 are described in U.S. Pat. No. 4,887,098.

Rear power bus 40 is connected at its two ends to terminals 46 that are supplied a voltage $V_{DD}$. $V_{DD}$ is typically 30 to 60 Volts. Similarly, front power bus 32 is connected at its two ends to terminals 46 that are supplied $V_{DD}$, but these connections are made at each end through a series ballast resistor 48. In a preferred embodiment, series ballast resistors 48 are diffusion resistors, side bus portions 42 are also diffusion resistors, and these diffusion resistors are formed in the same process steps. Alternatively, ballast resistors 48 could be formed from heavily doped polysilicon, metal silicide, or other resistive materials. To aid in butting printheads 10 to form a page wide array, ballast resistors 48 are formed extending back from the front edge of printhead 10.

The resistance value chosen for ballast resistors 48 is a function of the number of heating resistors and the parasitic resistance of common return 36 and busses 32, 38, and 40. Appropriate values for ballast resistors 48 can be obtained by modeling the circuit of FIG. 4. The circuit model should take into account variation in $V_{gs}$ of drive transistors 34 caused by parasitic resistance of busses 32, 36, 38, and 40.

Figure 5:
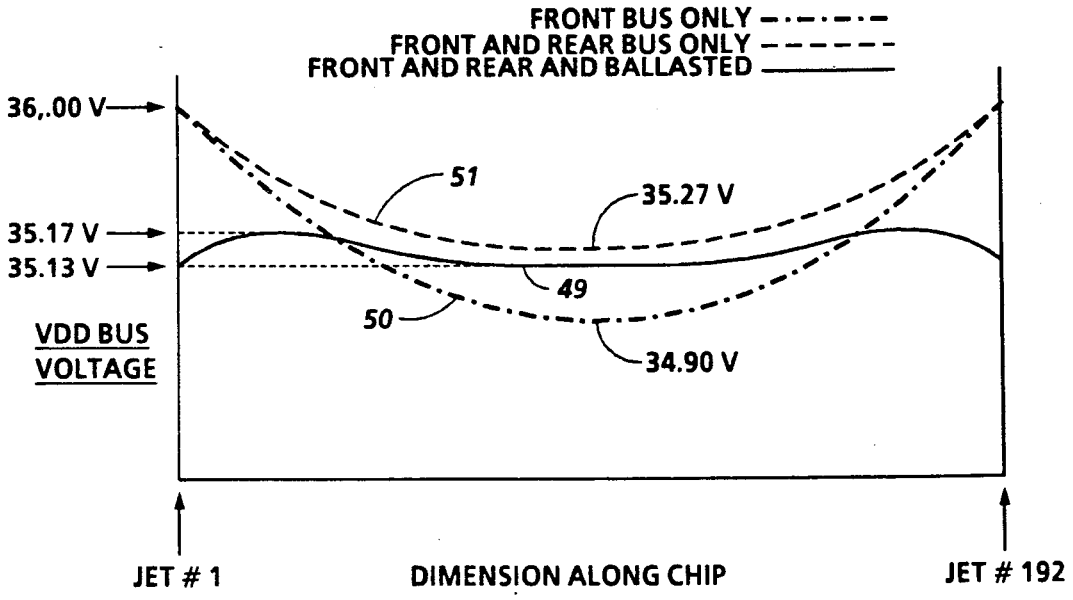
FIG. 5 is a graph that depicts the voltage delivered to each of the heating resistors of a 192 ink jet array of the improved heater board included in the printhead of FIG 1.

FIG. 5 is a graph having a curve 49 that depicts the voltage delivered to each of the heating resistors 24 along a 192 ink jet array of printhead 10. For comparison, the graph shows a curve 50 that depicts the voltage variation for a prior art printhead having a rear power busses, but not having ballast resistors (i.e., a design taught by U.S. Pat. No. 4,887,098), and a curve 51 that depicts the voltage variation for a prior art printhead having neither rear power bus nor ballast resistors. The curves 49, 50 and 51 shown are derived for printheads having 192 ink jets, heating resistors of about 8 to 10 Ω, firing four jets together (8 Watts each), a $V_{DD}$ of 36 volts, and 1.2 micrometer aluminum leads having sheet resistance of 0.027 Ω/□. In addition, printhead 10 has ballast resistors 48 of 150 Ω and side bus portions 42 formed from diffusion resistors having sheet resistance of 19 Ω/□.

In FIG. 5, from curve 51 note that a printhead having neither rear power busses nor ballast resistors experiences a large variation in the voltage delivered to heating resistors of the end ink jets, which receive 36 V ($V_{DD}$), and the voltage delivered to the heating resistors of the middle ink jets, which receive only 34.90 volts. From curve 50, note that in a printhead having a rear power bus, the voltage received by the middle ink jet heating resistors is increased to 35.27 volts. However, curve 50 still shows a significant disparity between the voltage delivered to end and middle heating resistors. Finally, in curve 49, printhead 10 has both rear power bus 40 and ballast resistors 48, and shows a voltage difference of only 0.04 volts between end and middle heating resistors 24.

Figure 6:
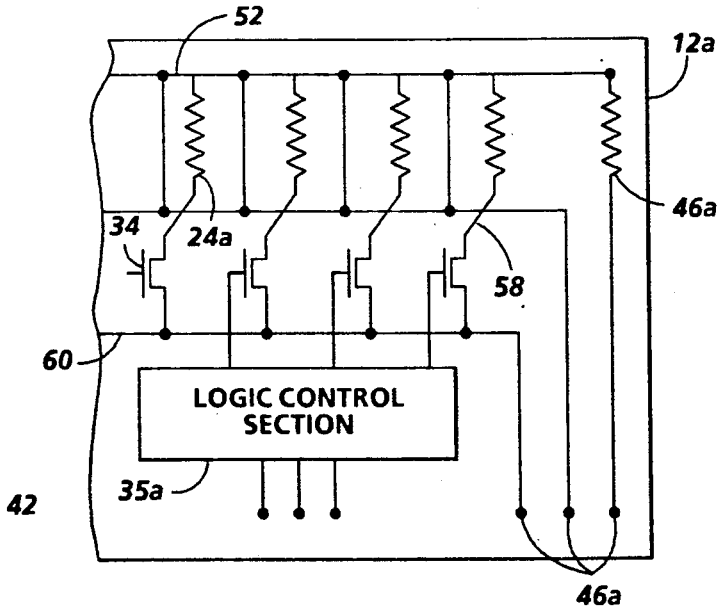
FIG. 6 a partial schematic top view of an alternate embodiment of the improved heater board included in the printhead of FIG. 1.

FIG. 6 shows a top view for an alternative crossover arrangement to that of the FIG. 4 embodiment. Like structures in the two figures are denoted by numbers followed by the letter a (e.g., heater board 12 in FIG. 4 becomes heater board **12*a* in FIG. 6). A front common return 52 extends along the relatively narrow space between heating resistors 24*a* and the front edge of heater board 12*a*, and connects to each heating resistor 24*a* by overlapping an edge of heating resistor 24*a*. Along the side of heating resistors 24*a* opposite front common return 52 extends a rear common return 54. Rear common return 54 connects to front common return 52 by means of side busses 56, which extend between adjacent heating resistors 24*a*. Heating resistors 24*a* connect to their respective drive transistors 34*a* by means of low resistance connections 58. Drive transistors 34*a* also connect to power bus 60. Low resistance connections 58 cross over (or under) rear common return 54. The same methods of construction discussed for side bus portion 42 can be applied to low resistance connections 58. Rear common return 54 is connected at its end to a terminal 46*a* that connects to ground (not shown). At each of its ends, front common return 52 connets through a series ballast resistor 48*a* to terminals 46*a*** that connect to ground (not shown).

While the invention has been described with reference to the structures disclosed, it is not confined to the specific details set forth but is intended to cover such modifications or changes as may come within the scope of the following claims. For example, although the preferred embodiments show the low resistance connection crossing under the common, some systems may use a crossover fabrication with the common being buried and the low resistance connector formed in overlying configuration.

We claim:

1. An ink jet printhead of the type having a plurality of channels, each channel being supplied with ink and having an opening which serves as an ink droplet ejecting nozzle a heating element being positioned in each channel, ink droplets being ejected from the nozzles by the selective application of current pulses to the heating elements in response to data signals from a data signal source, the heating elements transferring thermal energy to the ink causing the formation and collapse of temporary vapor bubbles that expel the ink droplets, said printhead further comprising a common return and a first and second electrically conductive power bus, two ballast resistors, said second power bus being connected at its ends to a predetermined voltage, said first power bus being connected at its respective ends to said predetermined voltage by a respective one of said ballast resistors, said power busses interconnected by a series combination of leads extending between said heating elements and respective low resistance connections which are formed beneath or above said common return.

2. The ink jet printhead of claim 1 wherein said first and second power busses are aluminum and said low resistance connection is an n+diffusion in a p-type silicon wafer.

3. The ink jet printhead of claim 1 wherein said first and second power busses are aluminum and said low resistance connection is heavily doped polysilicon on a field oxide.

4. The ink jet printhead of claim 1 wherein said first and second power busses are aluminum and said low resistance connection is metal silicide formed on n+or p silicon.

5. The ink jet printhead of claim 1 wherein said first and second power busses are aluminum and said low resistance connection is a silicide/polysilicon stack.

6. The ink jet printhead of claim 1 wherein said first and second power busses are aluminum and said low resistance connection, is aluminum.

7. The thermal ink jet printhead of claim 1 wherein said low resistance connection is formed above said second power bus.

8. The thermal ink jet printhead of claim 1 further including a transistor switch connected between the resistor and the signal source.

9. The thermal ink jet printhead of claim 8 wherein said low resistance connection is formed in the same process step as said ballast resistors.

10. An ink jet printhead of the type having a plurality of channels, each channel being supplied with ink and having an opening which serves as an ink droplet ejecting nozzle a heating element being positioned in each channel, ink droplets being ejected from the nozzles by the selective application of current pulses to the heating elements in response to data signals from a data signal source, the heating elements transferring thermal energy to the ink causing the formation and collapse of temporary vapor bubbles that expel the ink droplets, said printhead further comprising a first and second electrically conductive common return, two ballast resistors, said second common return being connected at its ends to a predetermined voltage, said first common return being connected at its respective ends to said predetermined voltage by a respective one of said ballast resistors, said common returns interconnected by leads extending between said heating elements, said heating elements connected between said first common return and said data signal source by a low resistance connection which is formed beneath or above said second common return.

11. The ink jet printhead of claim 10 wherein said first and second common returns are aluminum and said low resistance connection is an n+diffusion in a p-type silicon wafer.

12. The ink jet printhead of claim 10 wherein said first and second common returns are aluminum and said low resistance connection is heavily doped polysilicon on a field oxide.

13. The ink jet printhead of claim 10 wherein said first and second common returns are aluminum and said low resistance connection is metal silicide formed on n+or p silicon.

14. The ink jet printhead of claim 10 wherein said first and second common returns are aluminum and said low resistance connection is a silicide/polysilicon stack.

15. The ink jet printhead of claim 10 wherein said first and second common returns are aluminum and said low resistance connection is aluminum.

16. The thermal ink jet printhead of claim 10 wherein said low resistance connection is formed above said second common return.

17. The thermal ink jet printhead of claim 10 further including a transistor switch connected between the resistor and the signal source, said low resistance connection formed between the resistor and the transistor switch.

18. The thermal ink jet printhead of claim 17 wherein said low resistance connection is formed between said transistor switch and said signal source.

* * * * *